US009145736B2

(12) United States Patent
Peter et al.

(10) Patent No.: US 9,145,736 B2
(45) Date of Patent: Sep. 29, 2015

(54) TILTED BIT ROTARY STEERABLE DRILLING SYSTEM

(75) Inventors: Andreas Peter, Niedersachen (DE); Johannes Witte, Braunschweig (DE); Michael Koppe, Lachendorf (DE); Joachim Treviranus, Winsen/Aller (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 780 days.

(21) Appl. No.: 13/187,199

(22) Filed: Jul. 20, 2011

(65) Prior Publication Data

US 2012/0018225 A1 Jan. 26, 2012

Related U.S. Application Data

(60) Provisional application No. 61/366,453, filed on Jul. 21, 2010.

(51) Int. Cl.
*E21B 7/06* (2006.01)

(52) U.S. Cl.
CPC ..... *E21B 7/067* (2013.01)

(58) Field of Classification Search
CPC ..... E21B 10/00; E21B 7/04; E21B 7/06; E21B 7/064
USPC ..... 175/76
See application file for complete search history.

(56) References Cited

U.S. PATENT DOCUMENTS

| | | | | |
|---|---|---|---|---|
| 4,772,246 | A * | 9/1988 | Wenzel | 464/117 |
| 6,427,783 | B2 | 8/2002 | Krueger et al. | |
| 6,513,606 | B1 | 2/2003 | Krueger | |
| 6,837,315 | B2 | 1/2005 | Pisoni et al. | |
| 7,287,604 | B2 | 10/2007 | Aronstam et al. | |
| 7,413,032 | B2 | 8/2008 | Krueger | |
| 7,779,933 | B2 | 8/2010 | Sihler et al. | |
| 7,802,637 | B2 | 9/2010 | Aronstam et al. | |
| 7,866,415 | B2 | 1/2011 | Peters | |
| 7,931,098 | B2 | 4/2011 | Aronstam et al. | |
| 7,942,214 | B2 | 5/2011 | Johnson et al. | |
| 8,087,479 | B2 | 1/2012 | Kulkarni et al. | |
| 2009/0032302 | A1 | 2/2009 | Downton et al. | |
| 2009/0272579 | A1 * | 11/2009 | Sihler et al. | 175/45 |
| 2010/0025115 | A1 | 2/2010 | Kotsonis et al. | |

FOREIGN PATENT DOCUMENTS

WO WO 2009101477 A2 * 8/2009

* cited by examiner

*Primary Examiner* — Jennifer H Gay
*Assistant Examiner* — Caroline Butcher
(74) *Attorney, Agent, or Firm* — Mossman, Kumar & Tyler, PC

(57) ABSTRACT

A wellbore is formed by using an apparatus that may include a shaft having an end portion, a drill bit body tiltable about the end portion, and at least one actuator configured to apply a tilting force to the drill bit body.

20 Claims, 4 Drawing Sheets

TILTED BIT ROTARY STEERABLE DRILLING SYSTEM

CROSS-REFERENCE TO RELATED APPLICATIONS

This application claims priority from U.S. Provisional Application Ser. No. 61/366,453, filed Jul. 21, 2010, the disclosure of which is incorporated herein by reference in its entirety.

BACKGROUND OF THE DISCLOSURE

1. Field of the Disclosure

This disclosure relates generally to oilfield downhole tools and more particularly to drilling assemblies utilized for directionally drilling wellbores.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of current drilling activity involves drilling deviated and horizontal wellbores to more fully exploit hydrocarbon reservoirs. Such boreholes can have relatively complex well profiles. The present disclosure addresses the need for steering devices for drilling such wellbores as well as wellbore for other applications such as geothermal wells, as well as other needs of the prior art.

SUMMARY OF THE DISCLOSURE

In aspects, the present disclosure provides an apparatus for forming a wellbore in a subterranean formation. The apparatus may include a shaft having an end portion, a drill bit body tiltable about the end portion, and at least one actuator configured to apply a tilting force to the drill bit body. One or more components of the apparatus may be modular.

In aspects, the present disclosure provides a method for forming a wellbore in a subterranean formation. The method may include forming the wellbore using an apparatus that may include a shaft having an end portion, a drill bit body tiltable about the end portion, and at least one actuator configured to apply a tilting force to the drill bit body.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide a rotary steerable system for drilling wellbores. In general, the described steering methodology may involve deflecting the angle of the drill bit axis relative to the tool axis by tilting a body of a drill bit. In some embodiments, the drill bit may be tilted by using an actuator assembly that applies a tilting force to the drill bit. To compensate for drill bit rotation, the force may be sequentially applied to a specified azimuthal or circumferential location on the drill bit in order to create a geostationary tilt; i.e., a tilt that consistently points the bit at a desired drilling direction even when the drill bit rotates. As will become apparent from the discussion below, rotary steerable systems in accordance with the present disclosure may be constructed such that the drill bit, which may include relatively high-wear components, may be readily disconnected from the actuator assembly. Thus, the actuator assembly may be subjected to less wear during operation. In some embodiments, the actuator assembly may be modular in nature to facilitate repair or replacement of the steering system. Further, the features that enable bit tilt are positioned within the bit itself. Because the distance between the bit face and the center point of deflection is relatively small (e.g., perhaps half the length of the drill bit), the actuator assembly may require less power and need to generate less force than conventional steering systems to orient the drill bit. Still other desirable features will be discussed below.

Figure 1:
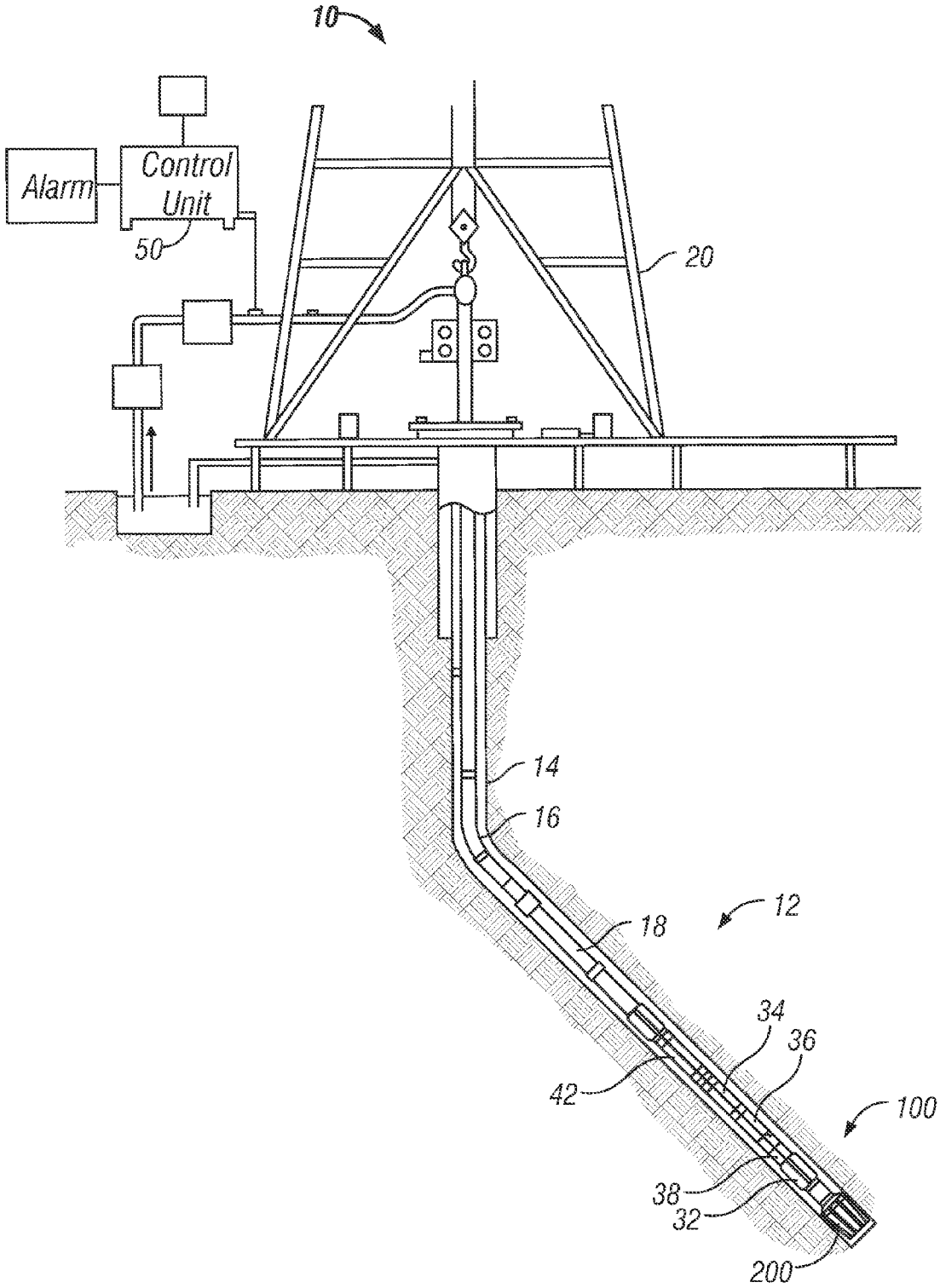
FIG. 1 illustrates a drilling system made in accordance with one embodiment of the present disclosure.

Referring now to FIG. 1, there is shown one illustrative embodiment of a drilling system 10 utilizing a steerable drilling assembly or bottomhole assembly (BHA) 12 for directionally drilling a wellbore 14. While a land-based rig is shown, these concepts and the methods are equally applicable to offshore drilling systems. The system 10 may include a drill string 16 suspended from a rig 20. The drill string 16, which may be jointed tubulars or coiled tubing, may include power and/or data conductors such as wires for providing bidirectional communication and power transmission. In one configuration, the BHA 12 includes a steerable assembly 100 that includes a drill bit 200, a sensor sub 32, a bidirectional communication and power module (BCPM) 34, a formation evaluation (FE) sub 36, and rotary power devices such as drilling motors 38. The sensor sub 32 may include sensors for measuring near-bit direction (e.g., BHA azimuth and inclination, BHA coordinates, etc.) and sensors and tools for making rotary directional surveys. The-near bit inclination devices may include three (3) axis accelerometers, gyroscopic devices and signal processing circuitry. The system may also include information processing devices such as a surface controller 50 and/or a downhole controller 42. The drill bit 200 of the steering assembly 100 may be rotated by rotating the drill string 16 and/or by using a drilling motor 38, or other suitable rotary power source. Communication between the surface and the BHA 12 may use uplinks and/or downlinks generated by a mud-driven alternator, a mud pulser and/or conveyed using hard wires (e.g., electrical conductors, fiber optics), acoustic signals, EM or RF.

Figure 2:
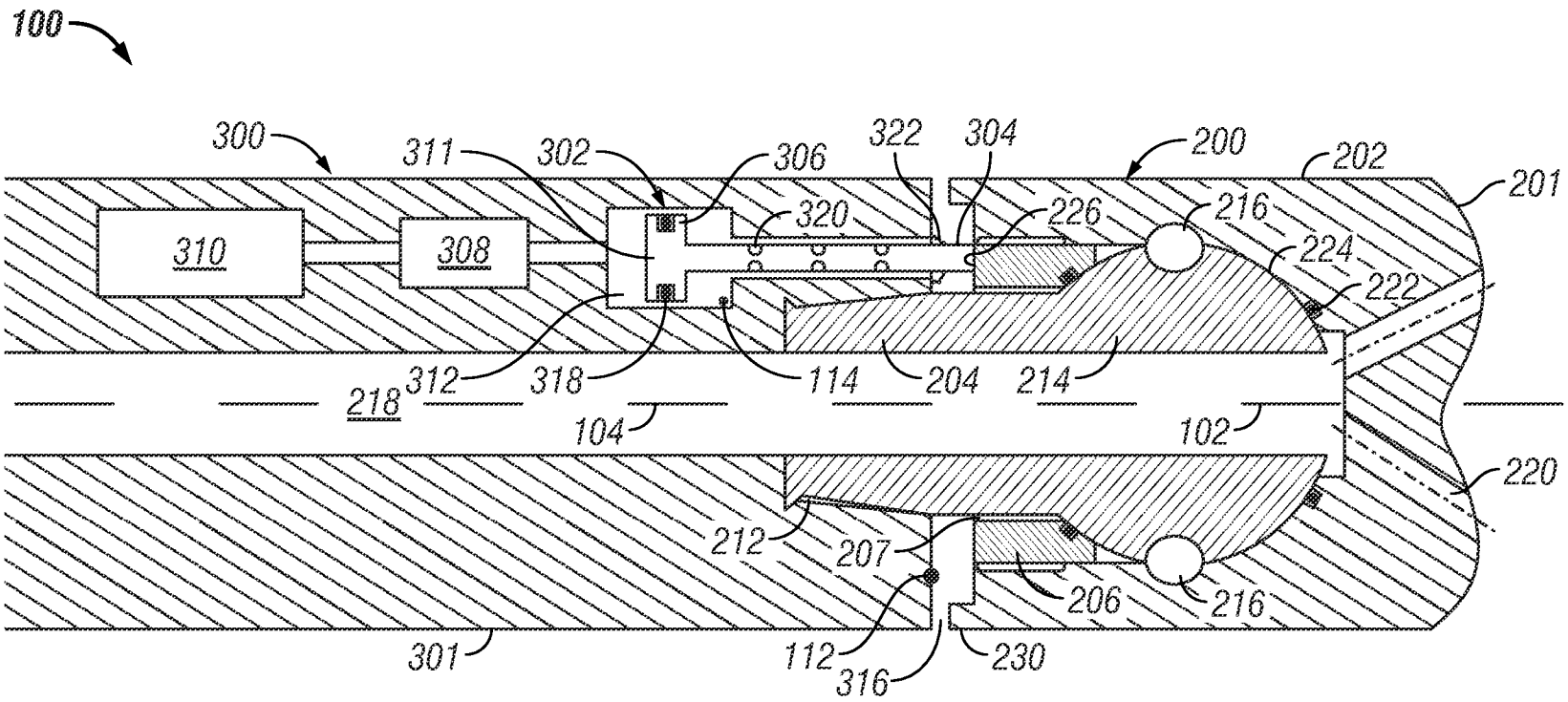
FIG. 2 schematically illustrates a steering device made in accordance with one embodiment of the present disclosure that uses a tiltable drill bit.
Figure 3:
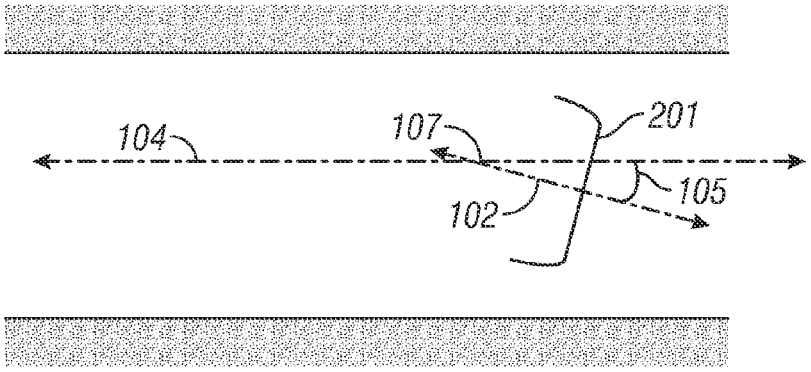
FIG. 3 illustrates a direction change associated with a tilt generated by a steering device made in accordance with one embodiment of the present disclosure.

FIG. 2 sectionally illustrates one steerable assembly 100 for directionally drilling a borehole in a subterranean formation. The steerable assembly 100 includes a tiltable drill bit 200 that may be oriented by an actuator assembly 300. Referring now to FIGS. 2 and 3, by orient, it is meant that the actuator assembly 300 can cause a specified angular deflection 105 between a bit axis 102 and a tool axis 104. The axes 102, 104 are generally aligned with the longitudinal axis of the wellbore (not shown). This angular deflection causes a bit face 201 to point in the desired drilling direction. The bit face 201 is generally the surface of the drill bit 200 that engages a bottom of the wellbore (not shown). As used herein, the term tilt refers generally to the angular deflection 105. Moreover, as will be discussed in greater detail below, the actuator assembly 300 maintains the angular deflection in a geostationary condition.

Referring to FIG. 2, in one embodiment, the drill bit 200 may include a bit body 202 that is coupled to a bit shaft 204. The bit shaft 204 may be secured in the bit body 202 with a connector 206. An annular gap 207 separates at least a portion of the bit shaft 204 and the connector 206. The gap 207 provides the space for tilting of the bit body 202. The bit shaft 204 may have an end 212 that is configured to connect to a housing or sub 301 associated with the actuator assembly 300. For instance, the end 212 may have a threaded joint. In some embodiments, the actuator assembly 300 may be considered as being selectively connected to the drill bit 200 in that the drill bit 200 may be removed from the housing 301 without disassembling or otherwise disturbing the actuator assembly 300. It should be noted that the tilt occurs about a support structure 214 positioned inside the drill bit body 202. The bit shaft 204 may be constructed as a universal-type, a Cardan-type joint, a joint that uses elastomeric members, or any other joint suitable for transmitting torque while being capable of undergoing a large angle of articulation. In one configuration, torque transmitting elements 216, which may be ball members, rotationally lock the drill bit shaft 204 to the drill bit body 202. Thus, the drill bit shaft 204 and the drill bit body 202 rotate together. In a conventional manner, drilling fluid is supplied to the drill bit 200 via a bore 218. The drilling fluid is ejected out of the drill bit body 202 via passages 220 to cool and lubricate the bit face 201 and wash away drill cuttings from the wellbore bottom as the bit face 201 cuts the wellbore bottom. Because the drilling fluid is at a relatively high pressure, seal elements may be used to prevent the drilling fluid from invading the interior of the drill bit body 202. For example, seals 222 may be used to provide a fluid tight seal, or lubricant containing chamber, around a region 224 that includes the mating surfaces of the bit shaft 204 and the bit body 202. The region 224 may be filled with grease, oil or other suitable liquid to lubricate the region and minimize contamination by drilling fluids or other undesirable materials.

Figure 4:
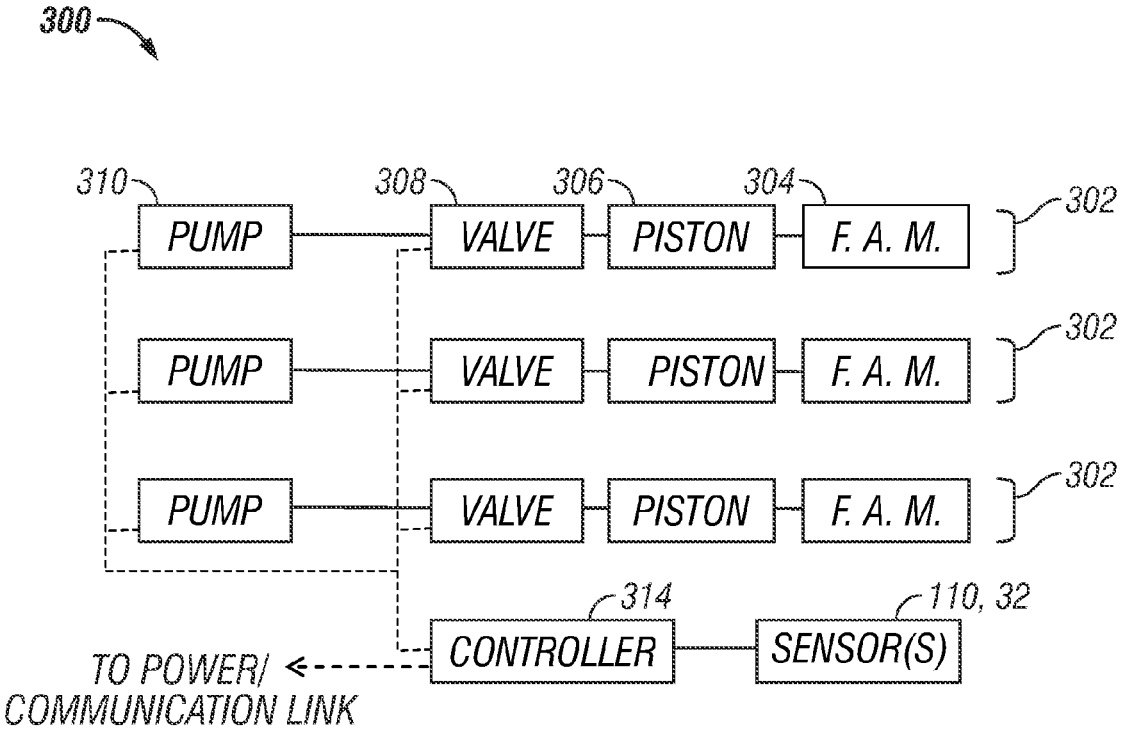
FIGS. 4 & 5 functionally illustrate embodiments of steering systems made in accordance with embodiments of the present disclosure.

Referring now to FIGS. 2 and 4, in one embodiment, the actuator assembly 300 may include actuators 302 that are circumferentially arrayed in the sub 301. While three actuators 302 are shown, greater or fewer numbers of actuators 302 may be used. In an illustrative arrangement, the actuator 302 may include a force application member 304, a piston assembly 306, a valve 308, and a pump 310. The force application member 304 may be a rigid member such as a rod that engages and applies a tilting force to the face 226 of the connector 206. As used herein, the term tilting force refers to a force applied to a specified azimuthal location on the bit body 202 that urges the bit body 202 to tilt in a desired direction. In the described embodiments, the force may be an axial force, but in other embodiments the force need not be aligned with the axis 104. Thus, for example, a weight-on-bit generated by the drill string is not a tilting force because the force is not applied preferentially to one specific azimuthal location on the bit body 202. The contacting portions of the force application member 304 and the face 226 may be hardened or strengthened. For example, the mating surfaces may be hardened using techniques such as carburizing or nitriding. Also, materials such as PDC may be used. For instance, the end of force application member 304 may include "polycrystalline diamond compact" (PDC) cutters, wear-resistant material that include tungsten carbide granules, etc.

The force application member 304 may be hydraulically actuated using the pump 310, valve 308 and piston assembly 306. The piston assembly 306 may include a piston head 311 that translates in a cylinder or chamber 312. In one arrangement, the pump 310 supplies pressurized hydraulic fluid via the valve 308 to the chamber 312 in which the piston head 311 is disposed. The valve 308 may be controlled to pulse or otherwise control the fluid flow into the chamber 312 to obtain a geostationary tilt angle.

In one arrangement, a controller 314 may be operatively connected to the valve 308 to control one or more aspects of the fluid flow into and/or out of the chamber 312 to obtain a geostationary tilt angle. For example, the controller may activate (e.g., open or close) the valve 308 based on the rotational speed of the drill bit 202. In some embodiments, the valve 308 may be activated once per drill bit revolution. In other embodiments, the activation may occur once per two revolutions or some other fractional amount that allows the tilt angle to remain generally geostationary. The controller 314 may be configured to filter, sort, decimate, digitize or otherwise process data, and include suitable PLC's. For example, the processor may include one or more microprocessors that use a computer program implemented on a suitable machine readable medium that enables the processor to perform the control and processing. The machine readable medium may include ROMs, EPROMs, EAROMs, Flash Memories and optical disks. The controller 314 may be the controller 42 of FIG. 1 or a separate controller.

When pressurized fluid enters the chamber 312, the piston head 311 and the force application member 304 are pushed axially toward the drill bit 202. In some embodiments, a base line biasing force may be generated in the chamber 312 using pressurized fluid and/or a biasing element (not shown) such as a spring. In cases where the force application member 304 is hydraulically actuated, sealing elements may be used to prevent leaking of pressurized hydraulic fluid. For example, seals 318 such as o-rings may be positioned on the piston head 311, sealing wipers 320 may be disposed on the rod portion of the force application member 304, and a metal or rubber membrane 322 may be positioned at an opening from which the force application member 304 protrudes.

In some embodiments, the force application member 304 traverses a circumferential gap 316 separating the housing 301 and the connector 206. The width of the gap 316 may be one factor that controls the magnitude or severity of the tilt of the bit body 202. To control bit tilt, a shoulder 230 may be formed on the bit body 202. The shoulder 230 may extend partially across the gap 316 to reduce the effective gap width and, therefore, limit the magnitude of the tilt. In some embodiments, the shoulder 230 may be adjustable.

In certain embodiments, the actuator assembly 200 and/or the actuators 302 may be modular in nature. In one aspect, the term modular refers to a standardized structural configuration having generic or universal coupling interfaces that enables a component to be interchangeable within the wellbore tool. An illustrative module may include the force application member 304, the piston assembly 306, the valve 308, and the pump 310. These components may be packaged in a unitary housing that may be removably disposed in the housing 302. Another illustrative module may include only the valves 308 or only the pump(s) 310. Thus, if a component fails or is in need of maintenance, a replacement component may be inserted in its place within the drilling assembly. In another aspect, the term 'module' refers to a component available as a plurality of modules. Each module may have a standardized housing for interchangeability while also being functionally or operationally distinct from one another (e.g., each module has different operating set point or operating range and/or different performance characteristics). For example, the force application members 304 may have different strokes or the pumps 310 may have different operating pressure values. Thus, as drilling dynamics change, the component module having the appropriate operating or performance characteristics to obtain optimal drilling efficiency is inserted into the wellbore drilling assembly.

In some embodiments, the steering device 100 may utilize one or more sensors 110, 32, to control the drill bit 200 and the actuator assembly 300. The sensors may be used to estimate a position, orientation, operating status, or condition of the drill bit body 202, the force application member 304, the valve 308, the pump 310, or any other component or device of the steering device 100. For example, a sensor 112 may be used to estimate the width of the gap 316 and a sensor 114 may be used to determine a position of the piston head 311 and/or force application member 304. Illustrative sensors include, but are not limited to, ultrasonic sensors, capacitive sensors, and piezoelectric elements. The sensors 110 may also include the sensors 32 (FIG. 1) that provide directional information.

It should be understood that numerous arrangements may be used to move the force application member 304. For example, the valve 308 may be formed as a static nozzle element that permits fluid flow above a threshold pressure value. In such an arrangement, the controller 314 may be operatively coupled to the pump 310, which may be an adjustable speed pump. Thus, the controller 314 may increase the speed of the pump 310 to increase pump pressure. The speed increases may be periodic in nature to pulse fluid into the chamber 312 at the desired frequency.

Figure 5:
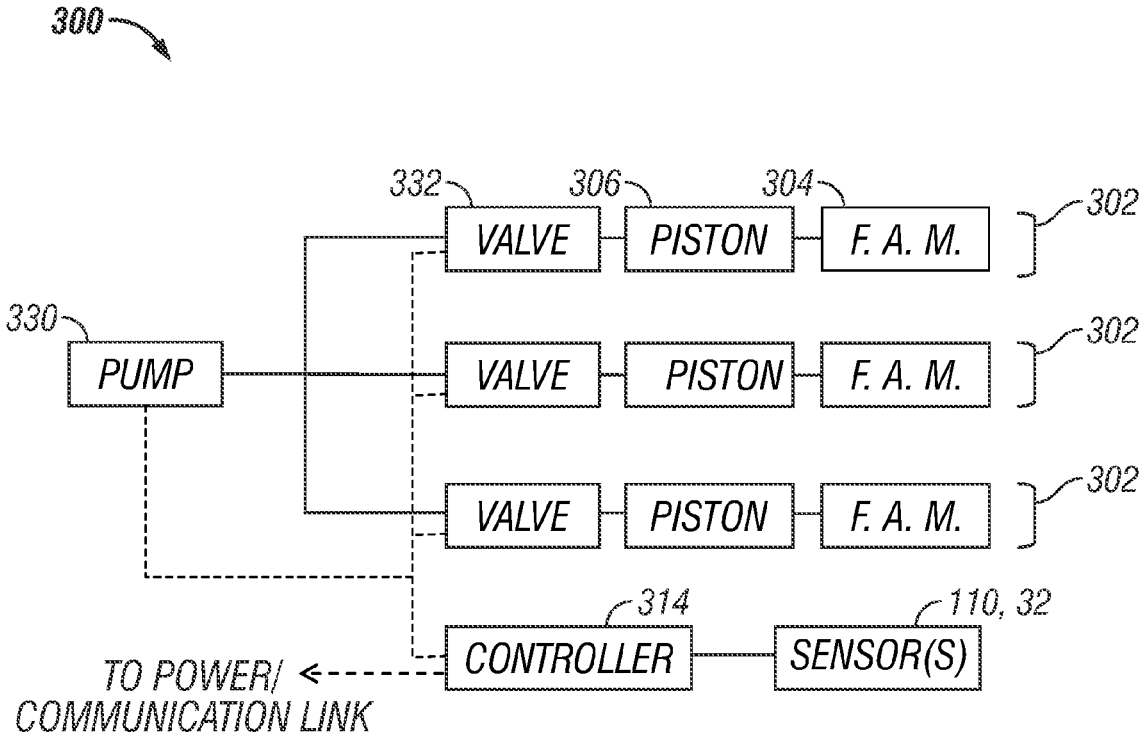

Referring now to FIG. 5, there is shown another arrangement for the steering system 300. In the illustrated arrangement, the actuator 302 may include a force application member 304, a piston assembly 306, valves 332, and a common pump 330. The common pump 330 supplies pressurized fluid to the valves 332 controlled by the controller 314. In this embodiment, the controller 314 may be programmed to control the valves 332 as needed to maintain a geostationary drill bit tilt. Numerous different pump configurations may be used to supply hydraulic power; e.g., radial piston pumps, axial piston pumps, swashplate pumps, etc. Still other embodiments may use a non-hydraulic system. For example, the actuator assembly may use electro-mechanical systems that include, but are not limited to, spindle drives, linear motors, and materials responsive to electrical current (e.g., piezoelectric materials).

The hydraulic systems may be energized using drill string rotation, high-pressure drilling fluid, a downhole electrical power generator, a downhole battery, and/or by surface supplied power. Similarly, the electrical power for these systems may be generated downhole, supplied from a downhole battery, and/or supplied from the surface. Referring now to FIGS. 1 and 4, for example, a bidirectional data communication and power module ("BCPM") 34 may be used to supply electrical power to the actuator assembly 300. Also, the BCPM 34 may be used to transmit control signals between the controller 314 and the surface.

Figure 6:
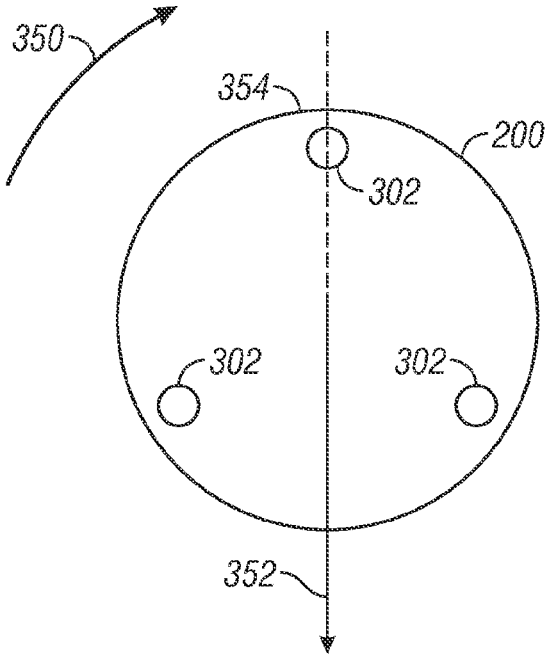
FIG. 6 schematically illustrates an operating mode of a steering device made in accordance with one embodiment of the present disclosure.

Referring to FIG. 6, there is schematically shown a sectional end view of the drill bit 200 that may be tilted using three circumferentially arrayed actuators 302. The drill bit 200 is shown rotating in a direction 350. Referring now to FIGS. 2 and 6, if it is desired to drill along the axis 104, i.e., with no deviation, then all of the actuators 302 are energized such that all of the force application members 304 engage the connector 206. The sensor 112 may estimate the tilt of the drill bit head 202. If needed, the controller 314 may adjust one or more of the actuators 302 to balance or control the applied axial forces in order to have a substantial zero tilt. For instance, the controller 314 may increase or decrease the fluid supplied to the piston(s) to hold the bit body 202 in a zero tilt orientation.

If it is desired to drill in a specified direction 352, then the controller operates the actuators 302 to apply axial force to the drill bit 200 to tilt the drill bit 200 in the specified direction 352. As mentioned previously, the drill bit 200 is rotating in direction 350. Thus, in one mode, the controller 314 (FIG. 4) may activate only the actuator 302 that is in an azimuthal sector 354 that is opposite of the drilling direction 352. This activation may be a signal to the valve 308 that opens the valve 308 to inject pressurized fluid into the chamber 312. In response, the piston head 311 displaces the force application member 304 against the connector 206. Once the actuator 302 leaves the azimuthal sector 354, the fluid pressure in the chamber 312 is released or reduced to a lower pressure value. This pressure loss allows the piston head 311 and the force application member 304 to slide back due to the weight-on-bit and the contact of the drill bit 200 against the formation. In one variant, the controller 314 (FIG. 4) may activate two or more of the actuators 302 to generate a resultant axial force in the azimuthal sector 354. Thus, each actuator 202 is activated as it rotates into the appropriate position and then deactivated as that actuator 202 rotates out of the appropriate position. That is, the actuators 202 are sequentially activated to continuously apply a tilting force to a specified azimuthal location.

In another mode, the controller 314 (FIG. 4) may activate only the actuator 302 that is in the same azimuthal sector as the drilling direction 352. This activation may be a signal to the valve 308 that opens the valve 308 to release pressurized fluid from the chamber 312. In response, the piston head 311 allows the force application member 304 to reduce the force applied to the connector 206. Once the actuator 302 leaves the azimuthal sector 354, the fluid pressure in the chamber 314 is increased to a desired pressure value. As before, the controller 314 (FIG. 4) may activate two or more of the actuators 302 to obtain a desired resultant tilting force.

It should be understood that the drill bit may rotate at speeds of one-hundred RPMs or greater. Thus, the actuators 302 may be activated for period on the order of a second or a fraction of a second. Nevertheless, because the axial force is always applied at or near the azimuthal sector 354, the tilt is geostationary.

In another mode of operation, the magnitude of the direction of drilling may also be controlled. In the example described above, the actuators 302 move the drill bit body 202 from a zero tilt orientation to a maximum tilt orientation. The actuator assembly 300 may also be configured to position or orient the drill bit 202 at a tilt value that is intermediate of zero tilt and the maximum tilt. In such an arrangement, the controller 314 may operate the actuators 302 to restrict the stroke of the force application member 304 to a less than maximum stroke or to apply a force that is less than a maximum force. Thus, the drill bit body 202 may not be tilted to the maximum value. The stroke may be limited by modulating or reducing the volume or pressure of a fluid applied to the piston head 311, by physically impeding movement of the force application member 304, or some other method.

Referring now to FIGS. 1, 2, and 4, in an exemplary manner of use, the BHA 12 is conveyed into the wellbore 14 from the rig 20. During drilling of the wellbore 14, the steering device 100 steers the drill string 16 in a selected direction. The drilling direction may follow a preset trajectory that is programmed into a surface and/or downhole controller (e.g., controller 50 and/or controller 42). The controller(s) 50 and/or 42 use directional data received from downhole directional sensors 32 to determine the orientation of the BHA 12. If a course correction is needed, the controller 314 transmits signals to the valves 308 and or the pumps 310 to cause the force application members 304 to tilt the drill bit body 202 in the desired direction. Moreover, these signals may also control the magnitude of the tilt. In another exemplary use, surface personnel transmit signals to the controller 314 to steer the drill string 16 in the desired direction. In still another exemplary use, geosteering may be performed using sensors in the FE sub 36. These sensors may include sensors for estimating gamma ray emissions, temperature, multiple propagation resistivity, sensors for determining parameters of interest relating to the formation, borehole, geophysical characteristics, borehole fluids and boundary conditions; formation evaluation sensors (e.g., resistivity, dielectric constant, water saturation, porosity, density and permeability), sensors for measuring borehole parameters (e.g., borehole size, borehole roughness. true vertical depth, measured depth), sensors for measuring geophysical parameters (e.g., acoustic velocity and acoustic travel time). In an automated, semi-automated, or surface-controlled manner, the BHA 12 may be steered relative to one or more specified formation or reservoir characteristic.

When desired, the BHA 12 may be pulled out of the wellbore. If desired, the drill bit 200 may be removed from the BHA 12 at the rig floor. It should be noted that the removal of the drill bit 200 may be performed by disconnecting the drill bit 200 from the housing 301. Other components, e.g., the actuator assembly 300, may remain in the BHA 12. Moreover, the separation of the drill bit 200, or selected components of the drill bit 200, may be performed with standard equipment and at the rig floor.

From the above, it should be appreciated that what has been described includes, in part, an apparatus for forming a wellbore in a subterranean formation. The apparatus may include a shaft having an end portion, a drill bit body tiltable about the end portion, and at least one actuator configured to apply a tilting force to the drill bit body.

From the above, it should be appreciated that what has been described also includes, in part, a method for forming a wellbore in a subterranean formation. The method may include forming the wellbore using an apparatus that may include a shaft having an end portion, a drill bit body tiltable about the end portion, and at least one actuator configured to apply a tilting force to the drill bit body.

While the foregoing disclosure is directed to the one mode embodiments of the disclosure, various modifications will be apparent to those skilled in the art. It is intended that all variations within the scope of the appended claims be embraced by the foregoing disclosure.

The invention claimed is:

1. An apparatus for forming a wellbore in a subterranean formation using a drill string, comprising:
- a shaft having an end portion, the shaft being configured to be disposed on the drill string;
- a joint coupled to the end portion, wherein the joint includes a bore for conveying a drilling fluid;
- a drill bit, the drill bit having a drill bit body and a bit face configured to cut a wellbore bottom, the drill bit tiltably disposed on the joint, wherein the drill bit body includes at least one passage in communication with the bore of the joint, the at least one passage ejecting the drilling fluid at the bit face, wherein the shaft traverses a circumferential gap separating the drill string and the drill bit, and wherein the joint is inside the drill bit and between the circumferential gap and the bit face; and
- at least one actuator configured to generate a tilting force to tilt the drill bit.

2. The apparatus of claim 1 wherein the at least one actuator includes a force application member; and further comprising a connector confining the end portion between the circumferential gap and the bit face, wherein the connector is separated from the drill bit body with an annular gap, wherein the force application member engages a face of the connector to apply the tilting force to the drill bit body.

3. The apparatus of claim 1, wherein the at least one actuator is positioned in the drill string, and wherein the at least one actuator includes a pump supplying pressurized fluid; a piston assembly energized by the pressurized fluid; and a valve configured to control fluid flow between the pump and the piston assembly.

4. The apparatus of claim 1, wherein at least one actuator is energized using an energy source selected from one: (i) pressurized fluid, and (ii) electrical power.

5. The apparatus of claim 1, wherein the at least one actuator is configured to apply the tilting force as a function of a rotational speed of the drill bit body.

6. The apparatus of claim 1, further comprising a controller operably coupled to the at least one actuator, wherein the controller is programmed to maintain a geostationary tilt of the drill bit body.

7. The apparatus of claim 6, further comprising a rotary power source rotating the drill bit body, the controller being programmed to operate the at least one actuator based on a rotating speed of the drill bit body.

8. The apparatus of claim 1, wherein the at least one actuator includes a plurality of actuators, and further comprising a controller operably coupled to the plurality of actuators, the controller being programmed to sequentially activate the plurality of actuators.

9. The apparatus of claim 1, wherein the joint is selected from one of: (i) universal joint, (ii) a cardan joint; and (iii) joint having an elastomeric member.

10. The apparatus of claim 1 further comprising:

a housing receiving the shaft and the at least one actuator, wherein the circumferential gap separates the housing from the drill bit, the circumferential gap being configured to permit a predetermined degree of tilt for the drill bit, and wherein the joint is positioned between the circumferential gap and the bit face; and at least one torque transmitting element positioned in an interior region of the drill bit, the at least one torque transmitting element connecting the joint to the drill bit.

11. The apparatus of claim 1, further comprising at least one torque transmitting element positioned in an interior region of the drill bit, the at least one torque transmitting element connecting the joint to the drill bit.

12. A method for forming a wellbore in a subterranean formation, comprising:

disposing a joint inside a drill bit body, the joint being positioned on an end portion of a shaft;

connecting the shaft to a housing positioned on a drill string, wherein the shaft traverses a circumferential gap separating the housing and the drill bit body, and wherein the joint is positioned between the circumferential gap and the bit face of the drill bit body;

forming the wellbore using the drill string; and controlling a drilling direction of the bit face by tilting the drill bit body about the end portion by applying a tilting force generated by at least one actuator.

13. The method of claim 12, further comprising positioning the at least one actuator inside the drill string, wherein the at least one actuator includes a pump, a piston assembly, and a valve, and further comprising:

energizing the piston assembly using a pressurized fluid from the pump, and controlling fluid flow between the pump and the piston assembly using the valve.

14. The method of claim 12, wherein the at least one actuator includes a plurality of actuators, and further comprising sequentially activating the plurality of actuators using a programmed controller.

15. The method of claim 12, further comprising applying the tilting force as a function of a rotational speed of the drill bit body.

16. The method of claim 12, further comprising maintaining a geostationary tilt of the drill bit body using a programmed controller that is operably coupled to the at least one actuator.

17. A system for forming a wellbore in a subterranean formation, comprising:

a drill string;

a shaft having an end portion, the shaft being configured to be disposed on a drill string;

a joint connected to the end portion;

a drill bit having a bit face engaging a bottom of the wellbore and tiltable about the end portion, the joint being positioned inside the drill bit, wherein the shaft traverses a circumferential gap separating the drill string and the drill bit and wherein the joint is positioned between the circumferential gap and the bit face; and and at least one actuator configured to tilt the drill bit by applying a tilting force.

18. The system of claim 17, wherein the shaft and the drill bit form a first assembly that is selectively connected to the at least one actuator.

19. The system of claim 18, wherein the first assembly is configured to be decoupled from the at least one actuator on a drilling rig floor.

20. The system of claim 17, wherein the shaft and the joint have a bore communicating drilling fluid through the drill bit, wherein mating surfaces of the joint and the drill bit body are in an interior region of the drill bit and between the circumferential gap and the bit face.

* * * * *